US005770010A

United States Patent [19]

Jelks

[11] Patent Number: 5,770,010

[45] Date of Patent: Jun. 23, 1998

[54] PULPING PROCESS EMPLOYING NASCENT OXYGEN

[75] Inventor: James W. Jelks, Sand Springs, Okla.

[73] Assignee: R-J Holding Company, Dayton, Ohio

[21] Appl. No.: 712,510

[22] Filed: Sep. 13, 1996

Related U.S. Application Data

[63] Continuation-in-part of Ser. No. 426,499, Apr. 20, 1995, abandoned.

[51] Int. Cl.[6] ..... D21C 5/02

[52] U.S. Cl. ..... 162/6; 162/19; 162/50; 162/65; 162/70; 162/76

[58] Field of Search ..... 162/4, 5, 6, 19, 162/24, 65, 70, 81, 82, 50, 63, 72, 73, 76; 423/523

[56] References Cited

U.S. PATENT DOCUMENTS

| | | | |
|---|---|---|---|
| 3,056,713 | 10/1962 | Gartner | 162/6 |
| 3,701,712 | 10/1972 | Samuelson | 162/65 |
| 3,759,783 | 9/1973 | Samuelson et al. | 162/65 |
| 3,806,404 | 4/1974 | Liebergott et al. | 162/50 |
| 4,016,029 | 4/1977 | Samuelson | 162/65 |
| 4,087,318 | 5/1978 | Samuelson et al. | 162/65 |
| 4,294,654 | 10/1981 | Turner | 162/50 |
| 4,450,044 | 5/1984 | Fritzvold et al. | 162/65 |
| 4,462,864 | 7/1984 | Carles et al. | 162/56 |
| 4,897,156 | 1/1990 | Samuelson | 162/65 |

OTHER PUBLICATIONS

E.J. Corey & Walter C. Taylor, *Peroxidation of Organic Compounds by Externally Generated Singlet Oxygen Molecules,* 86 Journal of the American Chemical Society 3881 (1964).

Hawley's Condensed Chemical Dictionary 809 (12th ed. 1993) (entry for "nascent").

Hawley's Condensed Chemical Dictionary 1041 (12th ed. 1993) (entry for "singlet oxygen").

David R. Kearns, *Physical and Chemical Properties of Singlet Molecular Oxygen,* 71 Chemical Reviews 395 (No. 4, 1971).

James F. Norris & Ralph C. Young, A Textbook of Inorganic Chemistry for Colleges 148 (1938).

E.A. Ogryzlo & A.E. Pearson, *Excitation of Violanthrone by Singlet Oxygen. A Chemiluminescence Mechanism,* 72 Journal of Physical Chemistry 2913 (No. 8, 1968).

Michael M. Rauhut, *Chemiluminescence,* in 5 Kirk–Othemer Encyclopedia of Chemical Technolgoy 416 (3d ed. 1979).

*Primary Examiner*—Joseph W. Drodge

*Attorney, Agent, or Firm*—Arnold, White & Durkee

[57] ABSTRACT

This invention relates to an environmentally preferred process for the delignification of a cellulosic biomass comprising pulp. The process uses the oxidative properties of nascent oxygen to complete pulping and bleaching operations. The process may be used in a pulping stage, a bleaching stage or can be used for both the pulping and bleaching stages of a delignification process. The process does not rely on large volumes of environmentally offensive chemicals such as caustic soda, sulfur, and chlorine to achieve delignification of the pulp. The delignification process entails providing a defiberized, lignin-containing biomass of cellulosic material; reducing said biomass to a fiber slurry of lignin-containing cellulosic material; adding a fiber protecting additive to said fiber slurry, modifying the lignin in said fiber slurry; by the in situ formation of nascent oxygen in said fiber slurry and extracting at least a portion of said lignin from said fiber slurry by washing said fiber slurry with an aqueous solution of an alkaline material.

62 Claims, 1 Drawing Sheet

PULPING PROCESS EMPLOYING NASCENT OXYGEN

RELATED APPLICATIONS

This application is a continuation-in-part of U.S. application Ser. No. 08/426,499, filed Apr. 20, 1995 now abandoned.

BACKGROUND OF THE INVENTION

1. Field of the Invention

The process of this invention relates to the delignification of lignocellulosic materials. The process of the invention can be utilized to remove up to about ninety five percent of the lignin from the lignocellulosic material without substantially degrading the strength of the lignocellulosic material. The removal of the lignin is achieved in the absence of elemental chlorine.

2. Description of Related Art

For use in paper-making processes, wood must first be reduced to pulp. Pulp may be defined as wood fibers capable of being slurried or suspended and then deposited upon a screen to form a sheet (i.e., of paper). Pulping or more generally delignification refers to the process in which wood chips or other wood particulate matter is converted into a fibrous form to produce pulp which can subsequently be deposited into paper or paper product. As a consequence of this pulping and indeed a primary objective of pulping is the removal of a non-fibrous, colored component of wood known as lignin. The methods employed to accomplish the pulping process usually involve either physical or chemical treatment of the wood, or a combination of these two treatments, to alter the wood's chemical form and to impart desired properties to the resultant product.

There are thus two main types of pulping techniques: mechanical pulping and chemical pulping. In mechanical pulping, the wood is physically separated into individual fibers. Mechanical pulps are broadly classified as (1) groundwood, and (2) chip/refiner pulp. The mechanical pulps are also referred to as "high yield pulps". In chemical pulping, the wood chips are digested with chemical solutions often referred to as pulping agents or pulping liquors. This invention is primarily concerned with this latter chemical type of pulping. For the purposes of this invention, processes resulting in the removal of lignin from lignocellulosic materials will be referred to broadly as delignification. In delignification processes, digestion of initial lignocellulosic material solubilizes most of the lignin thus permitting the lignin's removal. The lignocellulosic material subjected to these processes is sometimes referred to as the biomass. The intermediate obtained from the initial delignification process comprises primarily the cellulosic fibers that will be used to form the paper product and residual lignin. If a "brown" paper product is desired, delignification can essentially be stopped at this point. If white pulp used to manufacture white paper products is desired, then the intermediate may be and generally is subjected to a subsequent delignification process or processes in which additional lignin is removed. Although the term "pulping" is often used and indeed has been used herein to refer to much broader concepts, pulping will be used hereinafter to refer primarily to initial delignification steps, whereas subsequent delignification steps which result in the removal of residual lignin and the attainment of cellulosic material having desired properties, including color (typically white), will be referred to hereinafter as bleaching. Differences between these two delignification processes for the purposes of this invention will be explained in the discussion of wood composition which follows.

To understand the purposes and results of delignification processes, a description of the composition of wood is appropriate. Wood is comprised of two main components, a fibrous carbohydrate (i.e., cellulosic portion) and a non-fibrous component. The polymeric chains forming the fibrous cellulose portion of the wood are aligned with one another and form strong associated bonds with adjacent chains. The non-fibrous portion of the wood comprises a three-dimensional polymeric material formed primarily of phenylpropane units and known as lignin. Part of the lignin is located between individual cellulosic fibers, bonding them into a solid mass. However, a substantial portion of the lignin is distributed within the fibers themselves. Delignification steps in which the lignin removed is primarily that residing between the individual fibers will be generally referred to herein as pulping. Conversely, bleaching will generally be used herein to refer to those delignification steps in which the lignin removed is primarily that located within the individual fibers. However, it should be understood that these supposedly differentiated terms have been adopted primarily for convenience and that the boundary between these two delignification stages if it exists is often arbitrary. Removal of the lignin is desirable because the lignin readily forms color bodies when exposed to certain conditions, such as light or different pH levels. Additionally, other color bodies may be removed in the various pulping and bleaching steps, particularly in the bleaching steps. The degree of removal of lignin and these other color bodies is dictated by the color requirements for the intended paper product.

As indicated, both the cellulosic fibers and the lignin are polymeric in nature. One of the more important distinctions between these two structures is that the molecular weight of the cellulosic fibers is typically much higher, thus making them less susceptible although not completely impervious to the effects of the various digesting agents used to solubilize the lignin in the different delignification steps. The ability to remove the lignin in the pulping and bleaching processes is in part due to this lower molecular weight. The typical pulping and bleaching processes will alter the solubility of the lignin relative to the remaining biomass components, thus effectuating the removal of the lignin with the rest of the digesting medium or in subsequent washes. The various digesting agents are often referred to as liquors, with the agents used in the pulping steps referred to as pulping liquors and the agents used in the bleaching steps referred to as bleaching liquors.

The recovered and spent cooking liquor containing the modified and removed lignin is often referred to as spent or waste cooking liquor or black liquor. The black liquor is typically obtained as the result of several washing and extraction steps following the pulping process and preceding the bleaching process. The recovered cellulosic fiber is typically then subjected to a bleaching process to remove residual lignin and achieve a finished fibrous cellulosic product of a desired brightness and strength. The recovered liquor obtained after bleaching and containing the remaining lignin is often referred to as spent or waste bleaching liquor. The critical step in both of these processes is the solubilizing and removal of the lignin in a manner that does not result in the substantial weakening or destruction of the cellulosic matrix that provides strength to the final product being manufactured. The industry has developed many methods of measuring the degree of delignification but most are variations of the permanganate test. The normal permanganate test provides a permanganate or "K number" or "Kappa number" which is the number of cubic centimeters of tenth normal (0.1N) potassium permanganate solution consumed by one gram of oven dried pulp under specified conditions. It is determined by TAPPI Standard Test T-214. The acceptable Kappa number range will vary depending upon the intended use of the pulp (e.g., the Kappa number requirements for brown paperboard may vary from about 50 to about 90 while the requirements for white paper stock may be less than 5).

There are also a number of methods of measuring pulp brightness. This parameter is usually a measure of reflectivity and its value is typically expressed as a percent of some scale. A standard method is GE brightness which is expressed as a percentage of a maximum GE brightness as determined by TAPPI Standard Method TPD-103. The International Standards Organization (ISO) brightness test is also used.

The commonly utilized chemical delignification processes used in a pulping stage are broadly classified as: (1) the soda process, (2) the sulfite process, and (3) the Kraft process and its variety of well-known modifications. The soda process is well known in the art. It employs sodium hydroxide (NaOH) as the active reagent to break down the lignin and to assist in its removal. The Kraft process is an alkali process similar to the soda process except sodium sulfide ($Na_2S$) is added to the caustic soda (NaOH) used in the soda process. The Kraft process is preferred to the soda process because it has been found that the fibers and therefore paper obtained from the Kraft process are stronger than the comparable soda or sulfite derived products (i.e., the use of the Kraft process rather than the soda process or sulfite process leads to less degradation of the cellulosic fibers).

Conventional pulping processes therefore differ primarily in the type of chemical used as the "digesting medium" which separates the lignin from the cellulose. After lignin and cellulose are separated by the use of chemicals, the lignin is extracted from the "digested" solution by various "washing" processes, leaving the resulting pulp which can then if desired be bleached to the desired level. As stated hereinabove, there are three conventional processes that produce chemical type pulps. The Kraft process is the dominant process. It uses a mixture of caustic soda and sodium sulfide as the digesting medium to separate lignin. The Sulfite process uses an acid bi-sulfite salt as the digesting medium. Finally, the Soda process uses caustic soda as the digesting medium. All of these conventional processes are environmentally offensive; for example, the Kraft process requires significant amounts of a sulfur compound (sodium sulfide) to produce brown Kraft pulp, and significant amounts of various chlorine compounds in subsequent stages to produce bleached pulp.

As previously indicated, an additional concern with these and indeed all pulping processes is the removal of the lignin without the weakening or destruction of the cellulosic matrix (i.e., reduction of the molecular weight of the cellulosic fibers by oxidation or other means). Of the three conventional processes, the Kraft process is least susceptible to these degradation problems because several modifications to the Kraft process have been developed to address degradation concerns.

The modified Kraft techniques can result in less degradation in the polymeric structure of the cellulosic fibers during pulping and therefore can result in less strength loss in the resultant paper product in comparison to that occurring with the standard Kraft process. One modified Kraft pulping process is known as "extended delignification", which is a broad term used in the art to encompass a variety of modified Kraft techniques, such as adding the pulping chemicals in a specific defined sequence, or at different locations within the digester apparatus, or at different time periods, or with a removal and reinjection of cooling liquors in a prescribed sequence, so as to more effectively remove a greater amount of lignin while reducing the severity of the pulping liquor's chemical attack on the cellulosic fibers. Another modification of the Kraft process is the Kraft-AQ ("anthraquinone") process, wherein a small amount of anthraquinone is added to the Kraft pulping liquor to accelerate delignification while limiting the attack upon the cellulosic fibers which comprise the wood. However, even with these modifications, the Kraft process still results in some degradation of the cellulosic fibers.

Digestion of wood by a Kraft or modified Kraft process results in the formation of a dark colored slurry of cellulose fibers known as "brownstock". The dark color of the brownstock is attributable to the fact that not all of the lignin has been removed during digestion and has been chemically modified in pulping to form chromophoric groups. The actual level of residual lignin in the brownstock will vary depending on the intended use of the pulp. Brownstocks or functional equivalents used to manufacture brown paper goods will typically have a Kappa number about 90 or above and a viscosity of about 45 centipoise. Conversely, brownstocks or functional equivalents used to make white paper goods will typically have a Kappa number less than about 25 and a viscosity about 28 centipoise prior to being sent to a bleaching stage. Brownstocks of the latter variety are typically prepared by an extended Kraft process. Although not technically correct, cellulosic fibers obtained from other pulping processes and having similar Kappa numbers as Kraft brownstock are sometimes also referred to as brownstock. The lignin remaining in the brownstock is primarily that which resided within the fibers while the lignin removed with the waste pulping liquor and subsequent washes and extractions is primarily that located between the different fibers. In order to lighten the color of the brownstock pulp (i.e., to make it suitable for use as printing and writing and other white paper applications), it is necessary to continue the removal of the remaining lignin by the addition of delignifying materials and by chemically converting any residual lignin into colorless compounds by a delignification steps known as "bleaching" or "brightening". The need for this additional bleaching step points out another weakness of the commercially available pulping processes. Although the commercially available pulping processes can be employed somewhat successfully to remove the lignin located between the individual fibers without substantially degrading the cellulosic fibers, these same processes, due to their aggressive nature, can not be used to remove the lignin residing within the individual fibers (i.e., they can not be used in a bleaching step), Use of these pulping processes for bleaching purpose is expected to lead to substantial degradation of the cellulosic fibers.

As previously indicated, the various delignification processes culminate in washing and extraction steps conducted to remove chemical residue from the pulp. The residue, or black liquor, obtained from the washing and extraction steps is typically collected, concentrated, and then incinerated in an environmentally safe manner in a recovery boiler. The technique for the collection, concentration and burning of the black liquor is conventional and is well known in the art.

As previously indicated, bleaching, which typically follows the pulping process, is the delignification process or step conducted primarily to remove any residual lignin and to obtain fiber of a desired brightness lower than that obtained by the previously employed pulping processes. Again, prevention of the weakening or destruction of the fiber is a primary concern. Known bleaching processes, compared to the known and widely available pulping processes, are more suitable for the removal of the lignin residing within the individual fibers in part because the bleaching steps do not and indeed can not result in as great a reduction in cellulosic degradation.

Bleaching, as applied to cellulose was developed to whiten textiles. This technology has a long history and in fact dates back to ancient times. Egyptians, Phoenicians, Greeks, and Romans are known to have produced white linen goods. Little is known of the methods employed during those respective periods. Dutch, English, and other Europeans were producing white linens in the fourteenth century. Bleaching was achieved by exposing the goods to sunlight followed by "souring" and washing and repetition of the aforesaid sequence. Sour milk or buttermilk was known to be the "souring agent".

The first technical advance in bleaching was the discovery that a dilute solution of sulfuric acid could be used in place of sour milk as the souring agent. This advance was followed by the discovery of elemental chlorine and the subsequent discovery that elemental chlorine could be used for the bleaching of pulp. Elemental chlorine as used in the chlorination stage of bleaching reacts by addition to certain positions on the six carbon benzene ring portion of the lignin and by additionally or optionally splitting and addition to the aliphatic groups binding the benzene rings. The lignin, thus chlorinated, becomes soluble in heated caustic solution. The soluble, chlorinated lignin is removed by extraction and washing.

Elemental chlorine has proven to be an effective bleaching agent; however, it is difficult to handle and potentially hazardous to both mill personnel and equipment. For example, the effluents from chlorine bleaching processes contain large amounts of chlorides produced as the by-product of these processes. These chlorides readily corrode processing equipment, thus requiring use of costly materials in the construction of such mills. Further, without employing recovery systems requiring extensive, and therefore expensive, modifications, the build-up of chlorides within the mill precludes recycling the washer filtrate after a chlorination stage in a closed system operation. In addition, concern about the potential environmental effects of chlorinated organics in effluents, which the U.S. Environmental Protection Agency believes to be toxic to humans and animals, has caused significant changes in government requirements and permits for bleach mills. These include standards that may be impossible to meet with conventional bleaching or pollution control technology. Indeed, the pulp industry has proven and taken the stand that elemental chlorine can not be used indefinitely. The same position has been taken on hypochlorites which are often used as an alternative to elemental chlorine as a bleaching agent. However, a similar position has not been widely adopted with regards to chlorine dioxide. Perhaps, this is because chlorine dioxide acts primarily as an oxidizer rather than as a chlorinator.

To avoid these disadvantages, the paper industry has attempted to reduce or eliminate the use of elemental chlorine and most chlorine-containing compounds from multi-stage bleaching processes for lignocellulosic pulps. Complicating these efforts is the requirement that high levels (e.g., Kappa numbers lower than about 5 and often as low as 1) of pulp brightness are required for many of the applications for which such pulp is to be used.

In response to environmental and related concerns over the use of elemental chlorine based bleaching compounds, a variety of substitute materials have been proposed. The use of molecular oxygen, activated nitrogen and other common chemicals have been proposed as bleaching agents. The use of molecular oxygen, however, is not a completely satisfactory solution to the problems encountered with elemental chlorine. Molecular oxygen is not as selective a delignificationagent as elemental chlorine, and the Kappa number of the pulp, using conventional oxygen delignification methods such a bubbling molecular oxygen through a delignificationreactor, can be reduced only a limited amount until there is a disproportionate, i.e., unacceptable, attack on the cellulosic fibers. For example, the Kappa number of conventional brownstock with a Kappa number of about 40 can only be reduced to about 25 with conventional oxygen delignification methods before unacceptable degradation of pulp viscosity commences. Also, after oxygen delignification methods now in use, removal of the remaining lignin has heretofore typically still required the use of chlorination and chlorine bleaching methods to obtain a fully-bleached pulp. The level of chlorine used in these processes is typically reduced over conventional chlorine-only bleaching processes; however, even at such reduced chlorine concentrations, the corrosive chlorides soon reach unacceptable concentration levels in a closed cycle operation.

To avoid the use of chlorine bleaching agents, the removal of such remaining lignin with the use of ozone in the bleaching of chemical pulp has previously been attempted. Although ozone may initially appear to be an ideal material for bleaching lignocellulosic materials, the aggressive oxidative properties of ozone and its relative high cost have heretofore limited the development of satisfactory ozone bleaching processes for lignocellulosic materials, especially southern softwoods. Ozone will readily react with lignin to effectively reduce the Kappa number, but it will also, under most conditions, aggressively attack the carbohydrate which comprises the cellulosic fibers and substantially reduce the strength of the resulting pulp. Ozone, likewise, is extremely sensitive to process conditions such as pH with respect to its oxidative and chemical stability, and such changes can significantly alter the reactivity of ozone with respect to the lignocellulosic materials.

In addition to the above identified problems with chlorine-based bleaching processes, a number of studies now claim that the use of elemental chlorine, and most chlorine compounds, when used as bleaching agents, produce chlorinated dioxanes, chlorinated benzene compounds and/or chlorinated organic compounds that are said to be dangerous to human health and, indeed, potentially life threatening. As a result, the use of large quantities of chlorine and chlorine compounds are in disfavor as bleaching methods for pulp. Preferably, they would be used only to obtain the final removal of lignin and other color forming bodies.

As mentioned hereinbefore, a variety of chemicals have been used in attempts to perform pulping and bleaching operations in the absence of elemental chlorine. Use of nitric oxide (NO) and nitrogen dioxide ($NO_2$) is shown by the prior art, specifically, U.S. Pat. Nos. 4,076,579; 4,602,982; and 4,750,973. U.S. Pat. No. 4,076,579 discloses a treatment process for particulate lignocellulosic material whereby nitric oxide is added to said material in solution which is then reacted with molecular oxygen to form nitric acid ($HNO_3$) in situ. This reaction is followed by washing of the resulting material with alkali and extraction with alkali at a temperature of about 140° C. to delignify the cellulose and form pulp. U.S. Pat. Nos. 4,602,982 and 4,750,973 disclose a process for activating cellulose pulp by reacting the pulp with a gas comprising nitrogen dioxide ($NO_2$) and molecular oxygen ($O_2$) in the presence of water and sodium nitrate ($NaNO_3$). The operational use of nitric acid is also disclosed.

The second series of prior art references identifies methods of high consistency oxygen delignification using a low consistency alkali pretreatment. These prior art references disclose methods for treatment of wood pulp, and/or particularly to methods for oxygen delignification of the brownstock produced during standard pulping operations. These prior art oxygen methods comprise the oxygen based delignification of pretreated brownstock pulp followed by bleaching operations to increase the brightness of the pulps. Patents directed to these oxygen based lignocellulosic treatment operations are U.S. Pat. Nos. 5,085,734; 5,164,043; 5,164,044; 5,173,153; 5,174,861; 5,181,989; 5,211,811; 5,217,574; and 5,296,099.

SUMMARY OF THE INVENTION

In accordance with one aspect of the invention a process for the delignification of a cellulosic biomass is provided which comprises the steps of: providing a defiberized, lignincontaining biomass of cellulosic material; reducing said biomass to a fiber slurry of lignincontaining, cellulosic material; adding a fiber protecting additive to said fiber slurry; modifying the lignin in said fiber slurry by the in situ formation of nascent oxygen in said fiber slurry; and extracting at least a portion of said lignin from said fiber slurry by washing said fiber slurry with an aqueous solution of an alkaline material.

The source of the initial cellulosic biomass can be any number of pulp containing material including recycled paper, recycled paperboard, kenaf, wheatstraw, hemp, pulp wood, other annual plants, partially delignified lignocellulosic material, and combinations thereof.

The nascent oxygen can be produced by several reactions including the splitting of molecular oxygen with nitric oxide; the decomposition of hypochlorous acid to nascent oxygen and hydrochloric acid; the decomposition of ozone to nascent oxygen and molecular oxygen; the addition of nitric acid, nitric oxide to the pulp in the presence of a sulfite; and the electrochemical generation of nascent oxygen in the presence of an electrolyte. The process of the invention can be utilized in either a pulping mode, a bleaching mode, or both. One of the benefits of the process is that it can be repeated to achieve a final pulp product having a desired Kappa number without substantially degrading the pulp as indicated by a loss in viscosity.

In accordance with another aspect of the invention, the lignin modification step of the process is conducted at a temperature less than about 120° C. and the extraction step is conducted in an alkaline solution having a pH of between about 9 and about 11.

In accordance with another aspect of the invention a process for the bleaching of a partially delignified lignocellulosic material is provided which comprises the steps of: providing a biomass of partially delignified lignocellulosic material; reducing said biomass of partially delignified lignocellulosic material to a fiber slurry of lignin-containing, pulped, cellulosic material; adding a fiber protecting additive to said fiber slurry; modifying the lignin in said fiber slurry by the in situ formation of nascent oxygen in said fiber slurry at a temperature less than 120° C.; and extracting at least a portion of said lignin from said fiber slurry by washing said fiber slurry with an aqueous solution of an alkaline material wherein the alkaline solution has a pH between about 9 and about 11. The partially delignified lignocellulosic material may be comprised of one or more materials obtained from known pulping processes such as the Kraft process and the Kraft extended cook process.

In accordance with other aspects of the invention, products of the processes described are provided.

DESCRIPTION OF THE PREFERRED EMBODIMENTS

Figure 1:
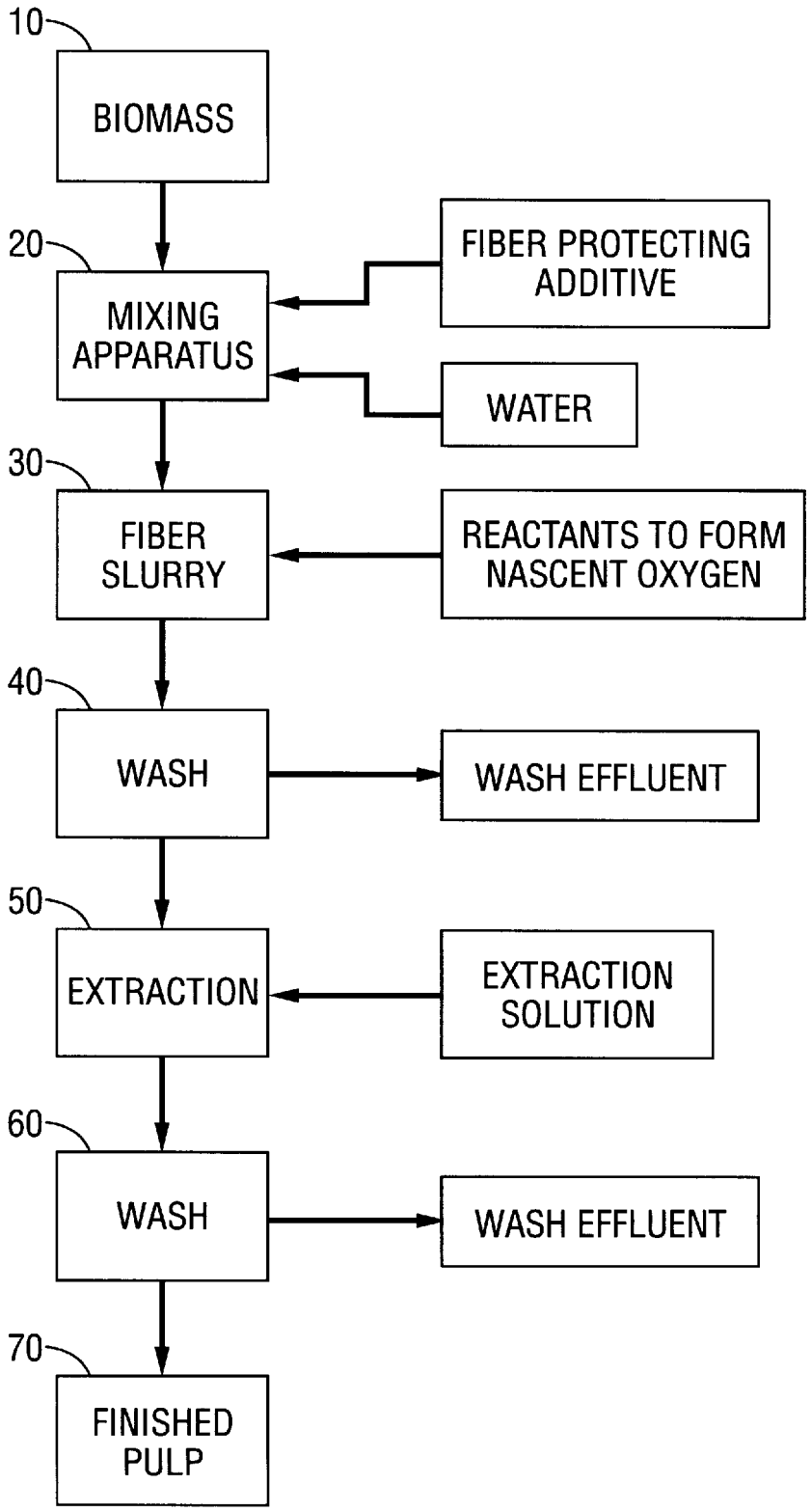
FIG. 1 is a flow chart illustrating schematically the steps in the process of this invention.

The process of this invention (referred to generically herein as the "LM process") is based on proprietary processes that separate lignin from cellulose (in both pulping and bleaching modes) without the use of substantial quantities of environmentally offensive chemicals. For example, in the Kraft process a sulfur compound (sodium sulfide) is used to "digest" lignin, resulting in brown Kraft pulp. The LM process, on the other hand, does not require extensive use of a sulfur compound to separate lignin from cellulose. It likewise does not require the use of substantial amounts of chlorine or chlorine-based chemicals in a bleaching stage to remove residual lignin and to achieve a final desired brightness.

For purposes of this application it should be understood that the term nascent or active oxygen refers to the atomic molecule of oxygen ($O_1$) having an atomic weight of 15.9994, an atomic number of 8 and a valence of 2. Nascent oxygen is extremely reactive. The term molecular oxygen refers to the molecule $O_2$ which is the natural gaseous form of oxygen. Molecular oxygen may be provided from the atmosphere or, alternatively, it can be provided from a pressurized commercial source such as a gas cylinder or a dedicated plant gas line. The $O_2$ molecule is relatively stable when compared to the $O_1$ atomic oxygen. Finally, the term ozone refers to the $O_3$ molecule which is also referred to as tri-atomic oxygen. Ozone is produced continuously in the outer layers of the atmosphere by the action of solar ultraviolet radiation on the molecular oxygen ($O_2$) of the air. In the laboratory, ozone can be prepared by passing dry air between two plate electrodes connected to an alternating current source of several thousand volts. Ozone is a bluish, explosive gas or liquid. It is a powerful oxidizing agent and is considered chemically unstable. Solutions containing ozone explode on warming. It has typically been felt that the use of ozone in a pulping type operation which generally requires heating would be difficult and dangerous due to the chemical instability of the ozone molecule.

It has been discovered that the in situ preparation of atomic or nascent oxygen is an effective way to utilize the chemical properties of the oxygen atom without at the same time exposing the users to a constant threat of explosion (i.e., with ozone). It is contemplated that the process as described in the subsequent embodiments can be used to replace either, or indeed both, current pulping or current bleaching processes. Use of nascent oxygen in accordance with the processes of the invention for either pulping or bleaching or both results in the removal of lignin without significant degradation of the cellulosic fibers.

The LM process is based on the discovery that nascent (atomic) oxygen generated in situ with a cellulose pulp slurry will selectively oxidize any lignin present in the said pulp slurry. It has been observed that the viscosity of the pulp will without further modification be significantly lowered by this treatment. However, a further discovery that lignin present with cellulose in a pulp slurry, can be selectively oxidized with nascent, (atomic) oxygen without significant loss of viscosity if during the lignin oxidation step the pH is maintained at about 3 and if during the lignin extraction step the pH is maintained at about 10. Preferably a magnesium salt or salts is present as a protective additive. Preferred magnesium protective additives include magnesium hydroxide.

Use of the protective additive is advantageous because exposure of nascent oxygen to the pulp at elevated temperatures and generally neutral pH conditions will, without the presence of the protective additive, lead to unacceptable property degradation. Use of the protective additive can be obviated to some extent if transitions from low pH conditions (such as in the oxidation and subsequently described acid wash steps) to high pH conditions (such as in the subsequently described alkaline extraction step) are rapid. However, the comfort level provided with the use of the protective additive suggests that it generally should be employed.

The oxidized lignin in the pulp is soluble in a dilute alkaline solution which allows for the production of pulp with very low Kappa numbers with high viscosity values. Pulp of this type possesses very high strength characteristics. Referring now to FIG. 1, the beginning material for application of the process of this invention in a pulping mode is a biomass 10 of lignin containing cellulosic material. Sources of such material are recycled paper, recycled paperboard, kenaf, wheat straw, hemp, pulp wood, or other annual plants, and combinations thereof. Any of the traditional sources for cellulosic fiber used for the manufacture of paper or paper related products can be used as the source for the biomass 10 of this invention. Preferably the biomass exists in the form of chips or other suitable particle form that has been defiberated, thus allowing for increased penetration of chemical pulping agents. Depending on the source, the initial biomass will have different Kappa number, viscosity, and pH characteristics. For example, a typical annual plant fiber might have an initial Kappa number of greater than 100, a viscosity greater than 100 centipoise, and a pH of about 5. A typical recycled and defiberated liner board might have an initial Kappa number of about 90, a viscosity about 45 centipoise, and a pH of about 8.

In the LM process, lignocellulosic materials, especially annual plant fiber, are subjected to the proprietary lignin oxidation and extraction steps at temperatures generally less than 200° C. These steps can be conducted over a wide range of temperatures; however, one of the benefits of the LM process is that delignification can be achieved in a reasonable time period at temperatures less than about 120° C. Because the proprietary lignin oxidation step, like most chemical pulping processes, has limited penetrating ability, thoroughly and evenly wetted fiber is employed in the preferred embodiment. Alternatively, a cellulosic source that has already been delignified to some extent can be used as the initial cellulose source for the process of this embodiment. However, it should again be emphasized that one of the benefits of the process of the embodiment is that it can be used in place of current more environmentally disapproved processes.

Subsequent to defiberating, the biomass 10 is placed in a mixing apparatus 20 wherein various fluids are added to convert the biomass into a fiber slurry 30. The biomass may be physically or chemically mixed to form a fiber slurry. In the preferred embodiment of this invention water is added to the biomass in the mixing apparatus together with a fiber protecting additive. The preferred fiber protecting additives are magnesium compounds such as magnesium hydroxide. Preferably, the magnesium-containing protective additive is employed at a level from about 0.1% to 0.4% magnesium on a basis of the weight of dried fiber employed.

After mixing in apparatus 20, the resulting slurry is transferred to a reactor vessel 30 where it undergoes further treatment. In one embodiment of this invention the mixing apparatus 20 and reactor vessel 30 arecombined as a single piece of hardware. In the reactor vessel 30, the fiber slurry is exposed to nascent oxygen formed in situ. The active oxygen is carried in the wet slurry so as to have uniform access to all of the biomass which selectively and equally reacts with the lignin. Active agitation to evenly mix water, biomass and the oxygen-carrying medium is suggested for optimal delignification. In the reactor vessel 30, the Kappa number and viscosity of the biomass 10 has not been substantially changed; however, the pH of the slurry containing the biomass 10 is about 3 and preferably less than about 3. The nascent oxygen selectively delignifies the fiber slurry by oxidation. Delignification is made possible because the nascent oxygen because of oxidation leaves the lignin more or less soluble in an aqueous alkaline wash. Excess water is removed from the oxygen-bearing reactant and biomass and the water is returned to the oxidation stage. The recycling of the water back to the oxidation stage is preferred because unreacted digesting chemicals contained therein reduce overall chemical requirements.

The amount of nascent oxygen required, and therefore the amount of digesting chemicals required, will vary depending on the amount of lignin present, or more precisely, the amount of lignin one desires to remove. Because atomic or nascent oxygen, when liberated, will react with many materials including lignin and other atoms of nascent oxygen, the reaction between nascent oxygen and lignin is the result of random collision, and accordingly inefficient. Thus, the randomness of collision must be taken into account when determining the amount of nascent oxygen needed. For example, when nascent oxygen is used to substantially delignify 25 Kappa number pulp prepared by Kraft extended cook, a treatment of about 1.0% by weight produced acceptable results.

After treatment with nascent oxygen in reactor 30 the resulting fiber slurry is washed to dispose of lignin and other chemicals that are present. In the preferred wash step 40 an acidic wash is used. The preferred acid is nitric acid in combination with water. Other materials well-known in the paper making art are equally useful in this particular washing step. During this washing step the pH is preferably maintained about 3.

An extraction step will normally conclude the pulping stage of the delignification process of the present embodiment. The extraction stage may comprise in this or a further embodiment, combining the substantially delignified pulp with an effective amount of an alkaline material in an aqueous alkaline solution for a predetermined time and at a predetermined temperature correlated to the quantity of alkaline material to solubilize a substantial portion of any lignin which remains in the pulp. The alkaline materials that are found most utility in the process of this invention are caustic soda, soda ash, aqueous ammonia, lime, and combinations thereof. The pH in the extraction zone is maintained between about 9 and about 11 preferably about 10.

After alkali extraction in zone 50 the pulp biomass is preferably sent to a second wash zone 60 in which the solubilized lignin is removed. The second wash zone 60 is typically a hot water wash zone resulting in a washer effluent with remaining chemicals, including lignin. After the second washing step the finished pulp 70 is recovered for use in the manufacturer of a final product.

The process allows for good control of the values for both Kappa number and viscosity. Generally, a target reduction in initial Kappa number of from about 75% to about 80% is desired. Similarly, the retention of from about 75% to about 80% of the initial viscosity is generally desired In certain instances a lower retention of viscosity might be acceptable if not desirable because of the increased susceptibility to bleaching associated with lower viscosity pulps.

For a typical annual plant fiber and liner board having initial Kappa numbers of greater than 100 and about 90 respectively, the following changes in Kappa numbers might be expected. After the initial acid wash, Kappa numbers of about 60 and about 54 might be expected. After extraction and a second wash, Kappa numbers of about 20 and 18 respectively might be expected. Likewise, the annual plant fiber with an initial viscosity of about 100 centipoise and liner board with an initial viscosity of about 45 might be expected to have viscosities of about 50 and about 37 respectively after the oxidation/acid wash/extraction/washsteps.

In other embodiments of this invention the finished pulp 70 may be recycled once or additional times through the steps represented by reactor 30, wash 40, extraction 50, and wash 60 to achieve the desired final pulp product. The resulting fiber product may depending upon the wood source be a pulp equivalent to brown Kraft pulp or "brownstock" in that the lignin residing between the individual cellulosic fibers has been substantially removed. However, the waste liquor does not contain the nocuous sulfur containing compounds that would be found in an actual Kraft brownstock. The extraction zone 50 results in the creation of a pulp product from which lignin has been selectively removed but wherein the strength of the cellulosic fiber matrix has not been significantly adversely affected. In this delignification stage, sufficient lignin is preferably removed to allow formation of hydrogen bonding between the individual cellulosic fibers, thus permitting felting and paper formation. The primary source of lignin removed in this initial pulping stage of delignification is again the lignin located between the individual fibers. The waste pulping liquor separated from the brownstock can be collected, concentrated, and then incinerated in an environmentally safe manner in a conventional recovery boiler. The resulting pulp is very responsive to various bleaching procedures, including and preferably the procedure herein described which employs the LM process as a second delignification stage. Pulps obtained from certain sources may require high levels of nascent oxygen to achieve the desired level of delignification;therefore, it may on occasion be necessary, as previously indicated, to perform several applications, or sequences of the proprietary LM process. Upon completion of the pulping process of this invention in certain embodiments it may still be desirable to bleach the end product. In performing such bleaching operations the use of non-elemental chlorine is preferred. The non-elemental chlorine products that have shown utility in bleaching the product of this invention are chlorine dioxide, hypochlorite, and combinations thereof. The use of hypochlorites is not favored because the industry has taken the same environmentally sensitive position on hypochlorites as it has for elemental chlorine (i.e., they can not be used indefinitely). However, a similar position has not been widely adopted with regards to chlorine dioxide. The chlorine dioxide acts primarily as an oxidizer rather than a chlorinator. However, the use of the LM process in a bleaching stage is preferred.

It is again reemphasized that as previously indicated, the process of this invention may be used in place of the prior art processes (either pulping, bleaching, or both) or in conjunction with such processes, depending on the final desired product and on local environmental rules and regulations. Therefore, the process of the invention can be used only in the pulping phase, only in the bleaching phase, or in both phases.

Thus, in accordance with another embodiment, the LM process is utilized as part of a bleaching stage in a delignification process in which residual lignin from a partially delignified lignocellulosic material is substantially removed and a final paperstock of a desired brightness and acceptable viscosity is obtained. Depending upon the source, the partially delignified lignocellulosic material will have different Kappa numbers, viscosities, and pH values. For example a conventional Kraft brownstock might have a Kappa number about 40, a viscosity of about 30 centipoise, and a pH about 7.5. An extended Kraft cook pulp might have a Kappa number about 20, a viscosity less than about 25 centipoise, and a pH about 7.7. A pulp obtained from the partial delignification of annual plant fiber by the LM process might as previously indicated have a Kappa number about 20, a viscosity about 50 centipoise, and a pH between about 6.5 and about 7.5. A pulp obtained from the partial delignification of recycled and defiberated liner board by the LM process might as previously indicated have a Kappa number about 20, a viscosity about 37 centipoise, and a pH between about 6.5 and about 7.5

In a typical Kraft pulp mill, after the Kraft brownstock is obtained by using sodium hydroxide (NaOH) and sodium sulfide ($Na_2S$) as the pulping agents, the pulp is then typically bleached using elemental chlorine or various chlorine compounds (such as chlorine dioxide, sodium hypochlorite, calcium hypochlorite, etc.). When the LM process, however, is used as part of a bleaching operation, the equivalent pulp product is bleached using the proprietary lignin oxidation and extraction processes that do not require substatntial quantities of chlorine compounds. The resulting bleached pulp is comparable to bleached Kraft pulp in strength and quality.

In the preferred means to bleach pulp using the LM process, the partially delignified pulp, advantageously obtained by employing the LM process in a pulping process, is treated with the proprietary oxidation step once more; however, the solutions and treatment are quite mild so as to react only with the remaining lignin, and not damage the fiber. The process can be repeated to sufficiently reduce the Kappa number to an acceptable level which will vary depending upon the intended paper product. In other embodiments, it may be desirable to subject the cellulosic material obtained from the bleaching process of the present embodiment to a final bleaching stage in which a traditional chlorine containing bleaching agent, preferably a hypochlorite or chlorine dioxide, is used to remove any residual lignin or other color bodies. If this final bleaching stage using a chlorine containing bleach is used, it is preferred that it is used only to obtain minor reductions in Kappa number; otherwise, the benefits of the process of the present embodiment (i.e., reduction in required volumes of chlorine containing compounds used) would be minimized. Optionally, a non-chlorine containing bleaching agent such as hydrogen peroxide ($H_2O_2$) can when necessary be used for this final bleaching operation.

Thus, in the LM process, a 3-stage bleaching sequence of lignin modification/extraction/hydrogen peroxide or a 5-stage bleaching process of lignin modification/extraction/lignin modification/extraction/hydrogen peroxide can be used which are functionally equivalent to the conventional 3-stage and 5-stage bleaching sequences performed on Kraft pulp using chlorine compounds. The waste bleaching liquor containing the oxygenated residual lignin can, like the waste pulping liquor, be collected, concentrated, and then incinerated in an environmentally safe manner in a conventional recovery boiler.

It has been found that the oxygen delignification step comprising the bleaching process can be conducted in the manner which allows for the removal of increased percentages of the remaining lignin in the partially delignified pulp without causing an unacceptable corresponding decrease in the viscosity of the pulp. Broadly, the bleaching process which has been identified is practiced by treating the partially delignified pulp from a pulping process at low to medium consistency as described below, with the required amount of alkali necessary for the oxygen delignification step so as to ensure uniform application of the alkali, and thereafter raising the consistency and delignifying at high consistencies.

The use of the LM process for bleaching using nascent oxygen ($O_1$) as the bleaching agent, comprises substantially uniformly combining partially delignified wood pulp, preferably Kraft brownstock pulp or the functional equivalent obtained by using the LM process in a pulping mode, with a liquid, preferably water, in a mixing apparatus 20 to form a slurry.

The oxygen delignification step which follows in a reaction vessel 30 is carried out by introducing nascent oxygen into the reactor 30. This cooking step is then preferably followed by a washing step as previously described. Physical properties that might be expected after this washing step are as follows: for conventional Kraft brownstock having an initial Kappa number about 90 and viscosity about 45 centipoise, a Kappa number of about 33 and a viscosity of about 26 centipoise might be expected; for an extended Kraft cook having an initial Kappa number about 25 and viscosity about 28 centipoise, a Kappa number of about 13 and a viscosity of about 20 centipoise might be expected; for annual plant fibers pulped by the LM process and having an initial Kappa number about 20 and a viscosity about 50 centipoise, a Kappa number of about 8 and a viscosity of about 30 centipoise might be expected; and for liner board pulped by the LM process and having an initial Kappa number about 18 and a viscosity about 37 centipoise, a Kappa number of about 8 and a viscosity of about 25 centipoise might be expected. This would be followed by an extraction step and optionally a second washing step as previously described. This improved process involving $O_1$ allows for the removal of at least 60% to over 75% of the residual lignin from the partially delignified pulp, compared to the 35–40% removable with conventional oxygen delignification steps, without the heretofore expected undesirable decrease in the relative viscosity. For example, bleaching using the LM process as described for the delignification of the previously described partially delignified lignocellulosic materials might be expected to result in final pulp products having the following properties: for the conventional Kraft brownstock, a Kappa number of about 22 and a viscosity of about 23 centipoise; for the extended Kraft cook, a Kappa number of about 5 and a viscosity of about 18 centipoise, for the annual plant fibers, a Kappa number of about 4 and a viscosity of about 27 centipoise; and for the liner board, a Kappa number of about 4 and a viscosity of about 21 centipoise. Conversely, if conventional oxygen delignification methods were employed for these bleaching operations, the following properties might be expected: for the conventional Kraft brownstock, a Kappa number of about 50 and a viscosity of about 28 centipoise; for the extended Kraft cook, a Kappa number of about 17 and a viscosity of about 22 centipoise, for the annual plant fibers, a Kappa number of about 14 and a viscosity of about 30 centipoise; and for the liner board, a Kappa number of about 12 and a viscosity of about 23 centipoise. Because of the unique process capabilities of this modified process, it clearly constitutes the preferred oxygen process for use in the method of this invention. As previously indicated, bleaching by means of the described LM process may in some embodiments be followed by a final bleaching using a chlorine-based bleach to achieve a final reduction in Kappa number.

The oxidation of lignin by nascent, atomic, oxygen is equivalent to the lignin modification of 4.432 pounds of chlorine (i.e., 0.226 pounds of nascent oxygen is equivalent to 1 pound of element chlorine). The amount of nascent, (atomic) oxygen required for substitution of chlorine is therefore 22.6% by weight of elemental chlorine used to effect equivalent delignification of a given pulp. The chemical requirement procedure has been to determine the intensity of oxidation wanted. The basis is to employ nascent, (atomic), oxygen at 22.6% of the amount of chlorine used for a specific delignification. It is assumed that the in-situ generation of oxygen is 90% efficient. The overall factor used is therefore 22.6%÷0.90=25.1%.

As previously indicated, a fiber protecting additive is preferably used when the LM process is used in a pulping mode. This is true as well for the use of the LM process for a bleaching operation. The preferred additive is again magnesium hydroxide. Preferably, the magnesiumcontaining protective additive is again employed at a level from about 0.1% to about 0.4% magnesium on a basis of the weight of dried fiber employed.

When determining the breadth of the potential uses of the LM process, it should be understood that the delignification process of this invention may be used in place of the prior art processes (either pulping or bleaching) or in conjunction with such processes, depending on the final desired product and on local environmental rules and regulations. The process of the invention can be used only in the pulping phase, only in the bleaching phase, or in both phases. The ability to use the LM process for both stages, pulping and bleaching, is a substantial benefit. A lignocellulosic material can be repeatedly subjected to the LM process to achieve a final cellulosic pulp having a desired brightness. Moreover, the use of the LM process in this fashion does not result in significant degradation of the pulp's strength. Use of commercial pulping processes such as the Kraft process in this way for both the pulping and bleaching stages might lead to substantial degradation of the pulp due to the aggressive nature of the Kraft digesting media. Use of a chlorine based digesting media for both steps in the delignification process would in part not be acceptable because of the huge volumes of the environmentally disfavored chlorine that would be required.

The economics of utilizing the LM process to produce pulp are significant. When the cost of using the LM process to produce bleached pulp is compared to the cost of using chlorine compounds in the Kraft process, the cost of lignin modification using the LM process is approximately one-fourth the cost of chlorine-equivalent pulp production. The cost savings associated with the use of the LM process are a result of a number of factors, including but not limited to the ability to recover and reuse effluents, smaller economies of scale not necessitating the treatment of extreme volumes of effluent, elimination of the need for substantial quantities of chlorine, and lower usage levels.

The LM process can be employed in a "greenfield" paper pulp facility or it can be the basis for retrofitting an existing facility to replace existing technology. The latter scenario should be particularly attractive for an existing facility that must comply with the federal government standards that will greatly restrict the discharge of effluents generated by conventional technologies. The economies of scale associated with the LM process will allow for the cost effective facilities to be constructed with production capacities of 100 tons of pulp per day; whereas facilities using conventional processes are generally constructed to produce upwards of 1,000 tons of pulp per day due to the treatment of effluent.

Elimination of elemental chlorine or chlorine compounds by substituting the LM process to modify and extract lignin in a conventional Kraft pulp mill would achieve significant cost savings in producing bleached pulp. Furthermore, lignin modification and extraction using the LM process would eliminate bleaching effluent waste streams when elemental chlorine and chlorine compounds are eliminated or significantly reduce bleaching effluent waste streams when at least elemental chlorine is eliminated from a Kraft pulp mill by allowing the bleaching effluent to go to the mill's evaporators and be incinerated in a recovery boiler. In essence, the environmentally offensive wastes associated with conventional chemical pulping are eliminated by the LM process, which additionally offers a more cost effective way to produce and bleach pulp.

Generation of nascent oxygen "in situ" with the pulp combined with methods that have been developed to maintain pulp viscosity, and therefore pulp quality is the basis of a new pulp delignification process. This process delignifies pulp to a desired brightness at a lower cost than the conventional pulping and bleaching methods. Quality of the pulp produced by generation of nascent oxygen in situ is equal or better than that conventionally produced insofar as it been observed. It should be noted that the procedures for generating nascent oxygen in situ as subsequently described can be used for either stage or both stages of a delignification process. Any of the methods described can be utilized for a pulping stage, a bleaching stage, or both. Optionally, one of the methods can be used for a pulping stage and another for a bleaching stage.

Molecular oxygen is mildly to moderately reactive with lignin. The reactions are probably limited to that part of lignin that is sufficiently reductive to split oxygen molecules. Typical sources of molecular oxygen will contain quantities, although very limited quantities, of atomic or nascent oxygen. The low concentrations of nascent oxygen in molecular oxygen sources restrict its effect.

Nascent oxygen reacts with pulp in several ways, two of which are by:

1) addition, generally with lignin to partially oxidize it. The partially oxidized lignin becomes more or less soluble in a water alkaline solution which allows removal from the pulp by washing.
2) disruption of the lignin by shearing the butane cross linking or by opening the benzene rings that are held together by the butane cross linking. This again allows the lignin to become more or less soluble in a water alkaline solution thus allowing its removal from the pulp by washing.

Several methods of generating nascent oxygen in pulp have been discovered and demonstrated. One of these is by splitting molecular oxygen. Preferred method is to dissolve the splitting agent in the water forming a pulp slurry. Molecular oxygen, which can come from air, is then introduced into the pulp slurry that contains the splitting agent.

1) Nitric oxide (NO) is such an agent. Nitric oxide is obtained by burning anhydrous ammonia with molecular oxygen, either as a pure source or as provided by air, in the presence of catalyst. ($4NH_3+50_2 \rightarrow 4NO+6H_2O$). Cost of anhydrous ammonia has historically been in the range of 7½¢ to 8¢ per pound. Economics of this reaction is enhanced by the fact that the combustion of anhydrous ammonia produces significant heat that must be immediately removed from the gasses produced by this combustion. Nitric oxide is sparingly soluble in water, but sufficiently so that when air is introduced into the pulp slurry with nitric oxide present nascent oxygen is released "in situ". ($NO+O_2 \rightarrow NO_2+O_1$). One mole of catalytically oxidized anhydrous ammonia therefore produces one mole nascent, atomic oxygen at 100% efficiency. Additionally the nitrogen dioxide produced can react with the benzene rings of the lignin forming a nitronium ion. The nitronium ion will eventually disassociate, yielding additional nascent oxygen and nitric oxide.
2) Optionally the nitric oxide, which acts as a source of nascent oxygen as indicated above, may be provided by reacting a nitrate salt, such as sodium nitrite ($NaNO_2$), and an acid, such as nitric acid, in the presence of water. The reaction occurs in several steps, but the overall reaction can be expressed as: $12NaNO_2+12HNO_3 \rightarrow 12NaNO_3+8NO+4HNO_3+4H_2O$. When this method is employed it is preferred to have a sulfite containing accelerator compound present. Sources of sulfite include sodium sulfite.
3) Although it is typically preferred that the use of sulfur containing compounds be avoided in the pulping process, in certain instances, the use of such materials has been shown to be beneficial in conjunction with the process of this invention. Nitrosylsulfuric acid ($HNO_5S$) is another source of nascent oxygen and nitric oxide. Nitrosylsulfuric acid acts as a nascent oxygen source by providing nitric oxide which splits further added $O_2$. The reactions are $2HNOSO_4+H_2O \rightarrow 2H_2SO_4+2NO+O_1$ followed by $NO+O_2 \rightarrow NO_2+O_1$. Nitrosylsulfuric acid ($HNO_5S$) is made by the reaction of nitric oxide, nitrogen dioxide and sulfuric acid (i.e., $2H_2SO_4+2NO+½O_2 \rightarrow 2HNOSO_4+H_2O$). An alternative method for creating the nitrosylsulfuric acid is the reaction of sulfur dioxide with nitric acid.

Nascent oxygen can also be generated by other methods for use in the LM process. For example, hypochlorites release nascent oxygen in situ with pulp to accomplish one of the nascent oxidations of lignin that subsequently allow removal of the lignin, or destruction of the lignin color bodies. The mechanism of generating and releasing nascent oxygen is as follows; carbon dioxide in the atmosphere reacts with calcium hypochlorite $Ca(OCl)_2$ to form hypochlorous acid (HOCl) and calcium carbonate. The calcium carbonate precipitates and the precipitate is removed by filtering. Reaction is: $Ca(OCl)_2+CO_2+H_2O \rightarrow CaCO_3+2HOCl$). Hypochlorous acid is unstable and breaks down into hydrochloric acid and nascent oxygen, ($HOCl \rightarrow HCl+O_1$).

In still another embodiment of this invention, nascent oxygen is produced in situ by producing hypochlorous acid in situ as the reaction product of sodium hypochlorite with hydrochloric acid. Reaction is: $NaOCl+HCl \rightarrow HOCl+NaCl$. However, this method is not favored because of the pH of the resultant solution and interference of the sodium ion.

Ozone, $O_3$ is a source of nascent oxygen. ($O_3 \rightarrow O_2+O_1$). Ozone is quite unstable, in fact explosive, and makes it difficult to get the nascent oxygen it releases "in situ" with the pulp. Accordingly, the use of ozone requires some extraordinary mixing with the pulp when it, ozone, is used as the in situ source of nascent oxygen. Sunlight when in contact with biomass containing cellulose generates ozone in minute quantities which is the genesis of the ancient bleaching procedures primarily used to bleach linen.

Nascent oxygen can be generated in situ electrochemically with pulp in the presence of electrolyte. ($HCl+H_2O+2e \rightarrow HOCl+H_2 \rightarrow HCl+O_1+H_2$). Electrolytes other than hydrochloric acid that are chlorine free are known. Potassium manganate can be oxidized to potassium permanganate in an electrolytic cell. Potassium permanganate can be further electrolyzed to permanganic acid and potassium hydroxide. Permanganic acid will release nascent oxygen in situ with pulp which is another example of electrochemical oxidation.

In still another embodiment of this invention the nascent oxygen in produced in situ by the addition of nitric acid to the fiber slurry. The applicant suspects that the addition of nitric acid and nitric oxide will produce nascent oxygen in situ with pulp. The reaction is preferably conducted in the presence of a sulfite accelerator as previously described and a magnesium protective additive as previously described. Additional nitric oxide is produced as a result of this reaction. As the liberated nitric oxide separates from the pulp and is exposed to air, nitrogen dioxide is formed. Upon cooling the nitrogen dioxide polymerizes into nitrogen tetroxide which condenses into a liquid. Upon exposure to water the nitrogen tetroxide produces quantities of the initial starting materials nitric acid and nitric oxide. Thus, raw material needs are minimized. The nascent oxygen reacts with the lignin as previously described. Moreover, the applicant suspects that the initial reaction leads to the nitration of the benzene ring of the lignin which during alkali extraction undergoes saponification, thus releasing additional nascent oxygen.

In a further embodiment the nascent oxygen is produced in situ by the addition of percarbonic acid to the fiber slurry. The percarbonate is unstable and will release nascent oxygen if mixed in situ with pulp.

The LM process allows the fiber (carbohydrate) portion of the slurry to essentially maintain it's original "degree of polymerization" which correlates to, and is measured by pulp viscosity (TAPPI TM 230).

In accordance with another aspect of the invention, the non-pulp components that are extracted can be further processed rather than disposed of as waste. The hydrolysate (also referred to as the waste liquor or black liquor) extracted in the initial pre-hydrolysis process is primarily composed of 5-carbon sugars that can be fermented to ethanol using fermentation and distillation technologies. The resulting sugars are separated from the inorganic solids. Hence, the ideal facility using the LM process would produce both pulp and ethanol. The lignin that is extracted has application as a fertilizer feedstock. In conventional processes, the black liquor containing the extracted lignin is used as boiler fuel. The lignin is consumed as fuel, and the ash from the boiler containing among other things sodium and sulfur is either landfilled or recovered and used with some further treatment to produce new pulping liquor. Because the LM process eliminates the need of a recovery boiler used in reclaiming spent chemicals (sodium sulfide), the oxidized lignin can be recovered and marketed.

In accordance with another aspect of the invention, the LM process is employed to remove residual lignin from waste or recycle paper that has previously been de-inked. In the previously described uses of the LM process, the production of pulp from woody chips or other virgin biomass has been contemplated. However, the LM process can also be applied to bleaching recovered waste paper. Accordingly, after waste paper has been de-inked, the LM process removes residual lignin contained in the pulp, reducing the Kappa number of the recycled pulp to a bleachable value (e.g., less than about 40),whereby finished bleaching can be accomplished preferably using bleaching agents other than chlorine compounds, and even more preferably the LM process as previously described.

Use of magazines and other coated grades of waste paper were heretofore a major source of recycled fibers. However, these materials were typically not deinked and used in process to obtain stable white paper because of the high level of lignin now found in these sources. That excess lignin can now be removed by the LM process and this former source of high grade used fiber can again be recovered.

Magazines and other high groundwood/high filler content waste paper results in the production of nonstable pulp that is not satisfactory for high grade white paper products and also results in excessive amounts of de-ink sludge. Carbohydrates exist in de-ink sludge to the extent of one fourth to one half of the dry basis solids. This carbohydrate is, for the most part, low molecular weight fragments of cellulose with high lignin content from modern white coated waste paper. This lignin interferes with hydrolyzing the carbohydrate to sugar. The LM oxidation process will allow hydrolysis of this carbohydrate to sugars for concentration to saleable molasses. After removal of the carbohydrates from the de-ink sludge it has been discovered that white clay filler can be reclaimed from the remaining sludge. The result is a saleable white filler and the near elimination of the solid waste leaving only a small amount of ash requiring landfill.

In an alternate embodiment of the LM process and chemicals disclosed can be effectively used to reclaim filler materials and bleaching materials from the pulped biomass. In practicing the LM process in certain instances the fibers obtained by the oxidative delignification process show low opacity values. Use of filler materials such as magnesium hydroxide and/or other magnesium salts have demonstrated the capability of maintaining the high viscosity of cellulose that is exposed to nascent oxygen pulping and bleaching.

The LM process is further described with the aid of the following examples. The terms and expressions which have been employed in the foregoing specification are used therein as terms of description and not limitation, and there is no intention, in the use of such terms and expressions, of excluding equivalence of the features shown and described or portions thereof, it being recognized that the scope of the invention is defined and limited only by the claims which follow the examples.

EXAMPLES

Example 1

An example using nascent oxygen generated in situ for kappa number reduction is as follows:

Starting kappa number of an extended Kraft cook, Southern Pine: 20.2. Viscosity: 27.3 cps. Nascent oxygen applied 1.2%, estimated efficiency 90%. Estimated oxygen reacted 1.2%×90%=1.08%

To produce 1 metric ton of bleached pulp, (90% estimated overall bleach yield) starting pulp weight in pounds=2.204.6 pounds, 0.9=2449.556 pounds. 2,500 pounds of pulp will be used for calculations for production of 1 metric ton of bleached pulp.

Nascent oxygen applied: 1.2% of starting pulp, (.D. basis=2,500 pounds×0.012=30.0 lbs. nascent oxygen, or 30 pounds, 16=1.876 pounds nascent oxygen/metric ton delignified pulp to produce 1 metric ton bleached pulp.

Anhydrous ammonia required=1.875 pound moles×17.03 mol. wt.=31.931 pounds per metric ton of bleached pulp. Cost at 8¢ lb. gives an ammonia cost of $2.56 per metric ton of bleached pulp produced. Oxygen cost will be negligible if compressed air is source of molecular oxygen: allow $1.00 per ton. Estimated oxidation cost of $3.56 per metric ton produced.

pH control and fiber protection chemical cost estimate. Chemical is quick dolomitic lime, i.e., ½ mole of magnesium oxide which gives a molecular wt. of (40.32=56.08) 2=48.2, normality 2. Dolomitic lime required is (48.2) 2×(110% 1.875 pound mols.)=49.707 pounds per metric ton bleached pulp to be produced.

Estimated cost of dolomitic lime at estimated price of 2½¢/pound=$1.25 per metric ton pulp produced. Total estimated chemical cost for oxidation to delignify pulp that replaces the chlorination bleach stage is $3.56+$1.25=$4.81 to produce one metric ton of bleached pulp.

The characteristics of the delignified pulp after this treatment, laboratory scale, were a kappa number 4.6, viscosity of 27.1.

Example 2

FIG. 1 is a process diagram showing how sample P 4 was made. This sample demonstrates the potential for replacing chlorine or chlorine—chlorine dioxide in the first stage of Kraft pulp bleaching stages. In this instance the nascent oxygen requirements was calculated on the chlorine and chlorine dioxide normally used for delignification of extended cooked Kraft pulp.

A modified Cuisinart food processor (mixer) was used to mix water and magnesium hydroxide with the pulp to be subjected to selective lignin oxidation. A vacuum reactor was used in lieu of a mechanical mixer for the actual selective lignin oxidation. This reactor was made from a modified aluminum steam pressure cooker equipped with a stainless steel liner that contained the "mixed pulp". The vacuum reactor is fitted with a manifold, valves, pressure gauge, vacuum gauge, nitric oxide connection, oxygen connection necessary to provide quick access to accomplish the steps that follow.

Calculated nitric oxide application, nitric oxide/oxygen addition was divided into three additions into the reactor. Each nitric oxide addition was followed by adding excess oxygen to the reactor to 2 atm. absolute, (approximately 15 psig). A vacuum was accomplished prior to each nitric oxide addition. Amount of nitric oxide was determined by difference in vacuum measurement on the basis of net volume in the reactor.

The selective lignin oxidation was followed by the "optional acid wash", (acid wash) which was used on a second sample. Removal of excess magnesium hydroxide may allow better oxidized lignin removal in the "alkaline extraction". Alkaline extraction was accomplished in a 0.5% caustic soda solution. Pulp was put into a 10 liter stainless steel vessel that was put into a steam pressure cooker. Nominal time at 15 psig used was 1 hour.

After caustic extraction excess "black liquor" was removed by vacuum filtration. Alkali extraction was followed by three hot water washes. Finished pulp is light brown with a low kappa number.

$NO_2$ effluent, acid effluent, hot water wash effluents would be manipulated so as to lower costs in commercial practice. The $NO_2$ would be condensed by cooling the effluent. It would be combined with the "acid effluent" and part of the washed effluent and compressed air which would convert the effluents to a mixture of nitric and nitrous acids that would be used for the acid wash at essentially "no cost". Excess was effluent would go to the evaporators and on to the recovery boiler.

Example 3

A sample was made by using nitrosylsulfuric acid. Damp pulp treated was 150 gms.=150 gms.×30% solids=45 gms. dry pulp basis. In this case, magnesium hydroxide was added to the pulp, let thoroughly mix (2 minutes). This was followed by addition of 10 drops, i.e., about 10/28 of a milliliter while pulp was still mixing. Oxidation occurred from atmospheric oxidation, about 10 minutes. Pulp was then alkali extracted. Larger quantities of nitrosylsulfuric acid give a lighter pulp, indicating pulp will extract to a lower kappa number.

Reactions with nitrosylsulfuric acid are: 1) synthesis of nitrosylsulfuric acid; $2H_2SO_4+2NO+\frac{1}{2}O_2 \rightarrow 2HNOSO_4+H_2O$. 2) Reactions with moist pulp: $2HNOSO_4+H_2O \rightarrow 2H_2SO_4+2NO+O_1$ followed by $NO+O_2 \rightarrow NO_2+O_1$.

What is claimed is:

1. A process for the delignification of a cellulosic biomass comprising the steps of:

(a) providing a defiberized, lignin-containing biomass of cellulosic material;

(b) reducing said biomass to a fiber slurry of lignin-containing cellulosic material;

(c) modifying the lignin in said fiber slurry by a step comprising in situ formation of nascent oxygen, not occurring as a result of hydrogen peroxide decomposition, in said fiber slurry; and (d) extracting at least a portion of said lignin from said fiber slurry by washing said fiber slurry with an aqueous solution of an alkaline material.

2. The process of claim 1, wherein a fiber protective additive is added to the fiber slurry prior to the formation of nascent oxygen.

3. The process of claim 2, wherein said fiber protective additive is magnesium hydroxide.

4. The process of claim 1, wherein nascent oxygen is obtained from the atmosphere.

5. The process of claim 1, wherein said lignin-containing biomass of cellulosic material comprises one or more materials selected from the group consisting of recycled paper, recycled paperboard, kenaf, wheatstraw, hemp, pulp wood, annual plants, partially delignified lignocellulosic material, and combinations thereof.

6. The process of claim 1, wherein said nascent oxygen is produced in situ with the reaction of nitric oxide and molecular oxygen.

7. The process of claim 1, wherein said nascent oxygen is produced in situ by the decomposition of hypochlorous acid to nascent oxygen and hydrochloric acid.

8. The process of claim 1, wherein said nascent oxygen is produced in situ by the decomposition of ozone to nascent oxygen and molecular oxygen.

9. The process of claim 1, wherein said nascent oxygen is produced in situ electrochemically in the presence of an electrolyte.

10. The process of claim 1, wherein the nascent oxygen is produced in situ by the reaction of nitric acid and nitric oxide.

11. The process of claim 10, wherein additional nitric oxide is liberated and wherein nitric oxide and nitric acid are recovered by the steps of:

reacting the additional nitric oxide with oxygen to form nitrogen dioxide;

polymerizing the nitrogen dioxide to form nitrogen tetroxide;

condensing the nitrogen dioxide and exposing it to water to produce nitric acid and nitric oxide; and recovering the nitric acid and nitric oxide.

12. The process of claim 1, wherein the process is used in a pulping mode.

13. The process of claim 1, wherein the process is used in a bleaching mode.

14. A process for the delignification of a cellulosic biomass comprising the steps of:

(a) providing a defiberized, lignin-containing biomass of cellulosic material;

(b) reducing said biomass to a fiber slurry of lignin-containing cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

15. The process of claim 14, wherein a fiber protective additive is added to the fiber slurry prior to the formation of nascent oxygen.

16. The process of claim 15, wherein said fiber protective additive is magnesium hydroxide.

17. The process of claim 14, wherein the pH of the solution is about 10.

18. The process of claim 14, wherein the fiber slurry in step (c) has a pH of less than about 3.

19. The process of claim 14, wherein the cellulosic biomass has an initial Kappa number greater than about 40 and wherein the process comprises the additional step of (e) recovering a biomass having reduced lignin content, and wherein the recovered biomass is subjected to steps (b), (c), (d), and (e) repeatedly to reduce the Kappa number to about 5.

20. The process of claim 14, wherein the lignin-containing biomass of cellulosic material of step (a) has a Kappa number greater than about 60.

21. The process of claim 14, wherein said lignin-containing biomass of cellulosic material comprises one or more materials selected from the group consisting of recycled paper, recycled paperboard, kenaf, wheatstraw, hemp, pulp wood, annual plants, partially delignified lignocellulosic material, and combinations thereof.

22. The process of claim 14, wherein said nascent oxygen is produced in situ with the reaction of nitric oxide and molecular oxygen.

23. The process of claim 14 wherein said nascent oxygen is produced in situ by the decomposition of hypochlorous acid to nascent oxygen and hydrochloric acid.

24. The process of claim 14 wherein said nascent oxygen is produced in situ by the decomposition of ozone to nascent oxygen and molecular oxygen.

25. The process of claim 14, wherein said nascent oxygen is produced in situ electrochemically in the presence of an electrolyte.

26. The process of claim 14, wherein the nascent oxygen is produced in situ by the reaction of nitric acid and nitric oxide.

27. The process of claim 14, wherein the process is used in a pulping mode.

28. A process for the pulping of a cellulosic biomass comprising the steps of:

(a) providing a defiberized, lignin-containing biomass of cellulosic material;

(b) reducing said biomass to a fiber slurry of lignin-containing cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

29. The process of claim 28, wherein a fiber protective additive is added to the fiber slurry prior to the formation of nascent oxygen.

30. The process of claim 29, wherein said fiber protective additive is magnesium hydroxide.

31. The process of claim 28, wherein the pH of the solution is about 10.

32. The process of claim 28, wherein the pH of the fiber slurry in step (c) is less than about 3.

33. The process of claim 28, wherein the cellulosic biomass has an initial Kappa number greater than about 40 and wherein the process comprises the additional step of (e) recovering a biomass having reduced lignin content, and wherein the recovered biomass is subjected to steps (b), (c), (d), and (e) repeatedly to reduce the Kappa number to about 5.

34. The process of claim 28, wherein the lignin-containing biomass of cellulosic material of step (a) has a Kappa number greater than about 60.

35. The process of claim 28, wherein said lignin-containing biomass of cellulosic material comprises one or more materials selected from the group consisting of recycled paper, recycled paperboard, kenaf, wheatstraw, hemp, pulp wood, annual plants, partially delignified lignocellulosic material, and combinations thereof.

36. The process of claim 28, wherein said nascent oxygen is produced in situ with the reaction of nitric oxide and molecular oxygen.

37. The process of claim 28, wherein said nascent oxygen is produced in situ by the decomposition of hypochlorous acid to nascent oxygen and hydrochloric acid.

38. The process of claim 28, wherein said nascent oxygen is produced in situ by the decomposition of ozone to nascent oxygen and molecular oxygen.

39. The process of claim 28, wherein said nascent oxygen is produced in situ electrochemically in the presence of an electrolyte.

40. The process of claim 28, wherein the nascent oxygen is produced in situ by the reaction of nitric acid and nitric oxide.

41. The process of claim 28 further comprising a bleaching operation.

42. The process of claim 41, wherein the bleaching operation comprises the additional step of (e) recovering a biomass having reduced lignin content, and subjecting the recovered biomass to steps (b), (c), (d), and (e) repeatedly to reduce the Kappa number to about 5.

43. The process of claim 42, wherein the pH of the solution is about 10.

44. The process of claim 42, wherein the pH of the fiber slurry in step (c) is less than about 3.

45. The process of claim 42, wherein the cellulosic biomass has an initial Kappa number less than about 40 and wherein the process comprises the additional step of (e) recovering a biomass having reduced lignin content, and wherein the recovered biomass is subjected to steps (b), (c), (d), and (e) repeatedly to reduce the Kappa number to about 5.

46. The process of claim 42, wherein said partially delignified lignocellulosic material comprises one or more materials selected from conventional Kraft brownstock pulp and extended Kraft cook pulp.

47. The process of claim 42, wherein said nascent oxygen is produced in situ with the reaction of nitric oxide and molecular oxygen.

48. The process of claim 42, wherein said nascent oxygen is produced in situ by the decomposition of hypochlorous acid to nascent oxygen and hydrochloric acid.

49. A process for the bleaching of a partially delignified lignocellulosic material comprising the steps of:

(a) providing a biomass of partially delignified lignocellulosic material;

(b) reducing said biomass of partially delignified lignocellulosic material to a fiber slurry of lignin-containing, pulped, cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

50. The process of claim 49, wherein a fiber protective additive is added to the fiber slurry prior to the formation of nascent oxygen.

51. The process of claim 49, wherein said fiber protective additive is magnesium hydroxide.

52. The process of claim 49, wherein said nascent oxygen is produced in situ by the decomposition of ozone to nascent oxygen and molecular oxygen.

53. The process of claim 49, wherein said nascent oxygen is produced in situ electrochemically in the presence of an electrolyte.

54. The process of claim 49, wherein the nascent oxygen is produced in situ by the reaction of nitric acid and nitric oxide.

55. The product obtained from a process for the delignification of a cellulosic biomass comprising the steps of:

(a) providing a defiberized, lignin-containing biomass of cellulosic material;

(b) reducing said biomass to a fiber slurry of lignin-containing cellulosic material;

modifying the lignin in said fiber slurry by a step comprising in situ formation of nascent oxygen, not occurring as a result of hydrogen peroxide decomposition, in said fiber slurry; and (d) extracting at least a portion of said lignin from said fiber slurry by washing said fiber slurry with an aqueous solution of an alkaline material.

56. The product of a process for the delignification of a cellulosic biomass comprising the steps of:

(a) providing a defiberized, lignin-containing biomass of cellulosic material;

(b) reducing said biomass to a fiber slurry of lignin-containing cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

57. The product of a process for the pulping of a cellulosic biomass comprising the steps of:

(a) providing a defiberized, lignin-containing biomass of cellulosic material;

(b) reducing said biomass to a fiber slurry of lignin-containing cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

58. The product of claim 57 wherein the product has a Kappa Number and wherein the Kappa number is less than about 40.

59. The product of a process for the bleaching of a partially delignified lignocellulosic material comprising the steps of:

(a) providing a biomass of partially delignified lignocellulosic material;

(b) reducing said biomass of partially delignified lignocellulosic material to a fiber slurry of lignin-containing, pulped, cellulosic material;

(c) modifying the lignin in said fiber slurry by a step comprising in situ formation of nascent oxygen, not occurring as a result of hydrogen peroxide decomposition, in said fiber slurry at a temperature less than 120° C.; and (d) extracting at least a portion of said lignin from said fiber slurry by washing said fiber slurry with an aqueous solution of an alkaline material wherein the solution has a pH between about 9 and about 11.

60. The product of claim 59, wherein the product has a Kappa number and wherein the Kappa number is less than about 10.

61. The product of claim 59, wherein the product has a Kappa number and wherein the Kappa number is about 5.

62. The product of claim 59, wherein the product has a viscosity and wherein the viscosity is from about 10 centipoise to about 30 centipoise.

* * * * *